US007789213B2

(12) United States Patent
Jimenez et al.

(10) Patent No.: US 7,789,213 B2
(45) Date of Patent: Sep. 7, 2010

(54) ARTICLE DISPENSING MACHINE

(75) Inventors: Joan Carles Jimenez, Sant Pere Sallavinera (ES); Miguel Delgado, Sant Pere Sallavinera (ES); Antoni Vilagines, Barcelona (ES); Xavier Clua, Terrassa (ES); Carles Marti, Lliss de Vall (ES)

(73) Assignee: Discapa, S.L. (ES)

( * ) Notice: Subject to any disclaimer, the term of this patent is extended or adjusted under 35 U.S.C. 154(b) by 383 days.

(21) Appl. No.: 11/883,045

(22) PCT Filed: Jan. 24, 2005

(86) PCT No.: PCT/ES2005/000028

§ 371 (c)(1),
(2), (4) Date: Jul. 24, 2007

(87) PCT Pub. No.: WO2006/079666

PCT Pub. Date: Aug. 3, 2006

(65) Prior Publication Data

US 2008/0156612 A1 Jul. 3, 2008

(51) Int. Cl.

| | |
|---|---|
| ***G07F 5/02*** | (2006.01) |
| ***G07F 5/10*** | (2006.01) |
| ***G07F 5/00*** | (2006.01) |
| ***G07F 11/00*** | (2006.01) |
| ***G07F 13/00*** | (2006.01) |
| ***G07F 15/00*** | (2006.01) |
| ***G07F 17/00*** | (2006.01) |

(52) U.S. Cl. ..... 194/247; 221/151; 221/264; 221/265; 194/255; 194/258; 194/292; 194/334; 194/338

(58) Field of Classification Search ..... 221/151, 221/152, 233, 234, 264, 265, 266; 194/200, 194/219–223, 226, 230, 231, 234–245, 255, 194/258, 292, 334, 337, 338, 351; 453/32; 700/236, 244; 222/2
See application file for complete search history.

(56) References Cited

U.S. PATENT DOCUMENTS 3,970,181 A * 7/1976 Rubio ..... 194/237

(Continued)

FOREIGN PATENT DOCUMENTS

ES 1 037 960 7/1997

(Continued)

*Primary Examiner*—Jeffrey A Shapiro
(74) *Attorney, Agent, or Firm*—Black Lowe & Graham PLLC

(57) ABSTRACT

The invention relates to an article-dispensing machine. The inventive machine comprises: a structure (1), a removable container (2) for articles, and a dispensing mechanism on the base of the container (2), which is actuated by an actuation shaft that is coupled to the shaft of a coin or token selector (6) which is mounted in the structure (1) in order to dispense one or more articles from the container (2) through a delivery outlet (7) following the introduction of one or more coins or tokens. According to the invention, when the door (15) is in the closed position, a single closure device (55), which is associated with said door (15), can be used to lock the container (2), the coin selector (6) and a coin or token collection box (52) in the respective operating positions thereof. When the aforementioned door (15) is open, the container (2) can be refilled or removed, the coin selector (6) can be removed and the collection box (52) can be accessed without the use of tools.

22 Claims, 10 Drawing Sheets

U.S. PATENT DOCUMENTS

| | | | | |
|---|---|---|---|---|
| 4,469,242 | A * | 9/1984 | Costa | 221/4 |
| 5,738,245 | A * | 4/1998 | Tomioka | 221/207 |
| 5,813,510 | A * | 9/1998 | Rademacher | 194/206 |
| 6,182,861 | B1 * | 2/2001 | Kovens et al. | 221/258 |
| 6,253,900 | B1 | 7/2001 | Watanabe | |
| 2001/0010315 | A1 | 8/2001 | Tomioka | |
| 2004/0206602 | A1 * | 10/2004 | Chang | 194/254 |

FOREIGN PATENT DOCUMENTS

| | | |
|---|---|---|
| ES | 2 186 519 | 5/2003 |
| JP | 2001 357 448 A | 12/2001 |
| JP | 2002 133 494 A | 5/2002 |

* cited by examiner

ARTICLE DISPENSING MACHINE

TECHNICAL FIELD

The present invention generally relates to an article-dispensing machine, and more specifically to a spherical article-dispensing machine, such as capsules containing a surprise object, actuated by a shaft controlled by a coin or token selector.

STATE OF THE PRIOR ART

A type of article-dispensing machines comprising a structure supporting an at least partly transparent container so as to contain articles to be dispensed is well known, which articles are generally spherical articles, for example, capsules containing a surprise object. A dispensing mechanism which is actuated by an actuation shaft that is coupled to a drive shaft controlled by a coin or token selector is installed in the base of said container. The drive power making the mentioned drive shaft rotate can be provided mechanically, for example by means of an electric motor, or manually by means of a crank available to the user. The introduction of one or more coins or tokens in said coin or token selector allows carrying out an actuation cycle of the dispensing mechanism, whereby it dispenses a predetermined number of said articles from the container, generally only one article, through a delivery outlet located in a place of the structure that can be easily accessed by the user.

Different types of dispensing machines and coin selectors that are applicable to dispensing machines of the type described above are also well known in the state of the art.

Document ES-A-1037960, of this applicant, describes a spherical article-dispensing machine of this type.

Patent ES-A-2186519 describes an article-dispensing machine in which the structure comprises an opening at its front part in which the container is arranged, which container has a transparent part. The container is mounted such that it can rotate a certain angle according to a horizontal axis so as to expose an upper opening for refilling articles. The dispensing mechanism is mounted in a lower part of the container and rotates together with such container when it is placed in a refilling situation. A closure device that is controlled by means of a key is arranged to lock or unlock the rotation of the container. When the container is in a working situation, a gear ring of the dispensing mechanism is engaged with a gear wheel connected to the drive shaft actuated by a crank of the coin selector. It is possible to access the inside of the coin selector for its repair or maintenance by rotating the container beyond the refilling situation. The configuration of a simple machine, by providing a structure of the type described above with a pedestal and an upper finishing, or a multiple machine, by stacking and fixing to one another two identical structures of the type described and placing the pedestal under the lower structure and the finishing on the upper structure is foreseen.

A drawback of this dispensing machine is that the coin selector and other inner mechanisms are difficultly accessed through the refilling opening of the container, unless a significant part of the structure, or each of the structures when the configuration is of a multiple machine, is disassembled. Likewise, once the coin selector is accessed, it is necessary to carry out several operations using tools in the event that such selector is wanted to be removed for its repair or maintenance. The same occurs with the container, because if it is wanted to be completely removed for its repair or maintenance, it is not enough to open the closure device with the key, but rather it is necessary to disassemble several parts using tools. On the other hand, the coins or tokens are collected in a box which is accessed through a door provided with an independent closure device. In short, the machine can have an excessive difficulty during the maintenance and repair operations, which can negatively affect the operating cost.

An objective of the present invention is to provide an article-dispensing machine provided with a single closure device which allows, in a closed position, locking the container, the coin selector and the coin or token collection box in the respective operating positions thereof, and which in an open position allows refilling or removing the container, removing the coin selector and removing the coins or tokens from the collection box or completely removing such collection box, without needing to use tools.

DISCLOSURE OF THE INVENTION

The present invention contributes to reach the previous and other objectives by providing an article-dispensing machine, of the type comprising a structure supporting a container for articles to be dispensed and a dispensing mechanism arranged in the base of said container. Said dispensing mechanism is actuated by an actuation shaft coupled to a drive shaft of a coin or token selector to dispense a predetermined number of said articles from the container through a delivery outlet in each actuation cycle of said dispensing mechanism, controlled by the introduction of one or more coins or tokens in said coin or token selector. The dispensing machine of the present invention is characterized in that said actuation shaft is coupled to said drive shaft of the coin or token selector by means of a coupling mounted such that it can slide but not rotate on said actuation shaft between a coupled position, in which said coupling can transmit a turning torque from the drive shaft to the actuation shaft, and an uncoupled position, in which the coupling is completely removed from the drive shaft. Elastic means are arranged on the actuation shaft to push the coupling towards said coupled position.

With this construction, it is possible to uncouple the actuation shaft from the drive shaft by means of a simple pressure on the coupling against the force of the mentioned elastic means, therefore the coin selector, which is mounted in a sliding manner in a direction transverse to the actuation shaft, can be removed without the aid of tools. The coin selector is mounted in a front panel of the structure in which the delivery outlet and an access opening to the coin or token collection box are further arranged. A door which is articulated in relation to the structure can adopt a closed position attached on said front panel, and a closure device controlled by a key allows locking the door in said closed position, thus immobilizing the coin selector in its operating position and covering the access to the collection box. Several openings in the door allow the access to the coin selector and to the delivery outlet when the door is closed.

The container is further mounted in a sliding manner with respect to the structure in an opening thereof on the front panel. A pair of bolts is mounted in a base frame of the container, which bolts are pushed and maintained in a fastened position by cam profiles existing in the door when the container is in an operating position and the door is closed. When the door is open, the bolts can be manually unfastened and the container can be partially removed in order to expose an upper opening thereof through which articles can refilled, or it can be completely removed for its repair or maintenance. The removing mechanism is incorporated in the base frame of the container and can be removed together with it. When the container is placed in its operating position, a gear ring of the removing mechanism automatically engages with a pinion of a gear train coupled to the actuation shaft without the use of tools.

With this construction, a single closure device installed in a door attached to the front panel of the machine allows, in its closed position, locking the container, the coin selector and the coin or token collection box in the respective operating positions thereof, whereas in its open position it allows refilling or removing the container, removing the coin selector and removing coins or tokens from the collection box or completely removing such box, without the use of tools. This allows considerably speeding up the refilling and maintenance operations, and reducing the cost of the operation.

The structure of the machine is designed as a module. Therefore, with a structure mounted on a pedestal and covered with an upper finishing, a simple machine is configured with two structures fixed one over the other, and a double machine is configured by installing a pedestal under the lower structure and a finishing on the upper structure, and so on. Other configurations can also be obtained by laterally coupling two or more structures or groups of structures.

BRIEF DESCRIPTION OF THE DRAWINGS

The previous and other advantages and features will be more fully understood from the following detailed description of several embodiments with reference to the attached drawings, in which.

DETAILED DESCRIPTION OF SEVERAL EMBODIMENTS

Figure 1:
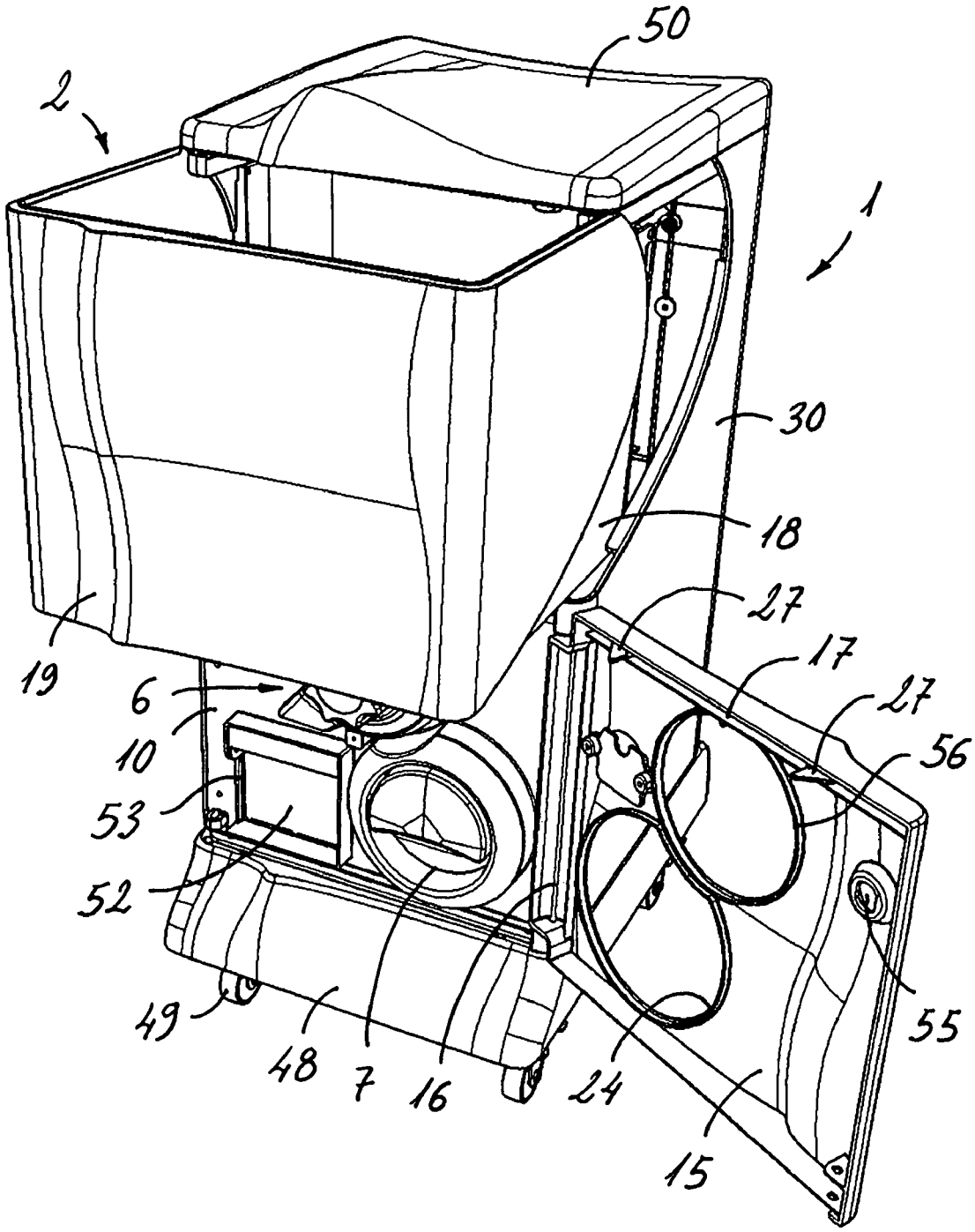
FIG. 1 shows a perspective view of an article-dispensing machine according to an embodiment of the present invention, with the door open and the container partially removed, in a refilling position.

With reference first to FIG. 1, the article-dispensing machine according to the present invention comprises a structure 1 supporting a container 2 adapted to contain articles to be dispensed. A dispensing mechanism 3 (FIG. 6) is arranged on the base of said container 2, which mechanism is actuated by a actuation shaft 4 coupled to a drive shaft 5 of a coin or token selector 6 (FIG. 4) to dispense a predetermined number of said articles from the container 2 through a delivery outlet 7. Said dispensing mechanism 3 is generally adapted to dispense a single article in each actuation cycle controlled by means of the introduction of one or more coins or tokens in said coin or token selector 6. The dispensing mechanism 3 is adapted to the shape and size of the article, and is generally favorable for providing the articles with a spherical shape. The articles are usually spherical capsules containing different surprise objects with irregular shapes.

The container 2 has a base frame 18 and one or more transparent walls 19, and is adapted to move horizontally in a sliding manner in relation to the structure 1, between a filling position (shown in FIG. 1), in which a portion of the container 2 projects from the structure 1 providing an upper filling opening, and a working position (shown in FIG. 13), in which the container 2 is integrated in the structure 1. As explained in detail below, the dispensing mechanism 3 is installed in said base frame 18 and is operatively and automatically connected and disconnected to the actuation shaft 4 when the container is located in its working and filling positions. Furthermore, if necessary, it is possible to completely remove the container 2 from the machine by pulling the container 2 from its filling position.

In the embodiment shown, the coin selector 6 is a known manually actuated type and comprises a crank or a knob 58 (FIGS. 4 and 5) connected to said drive shaft 5, and a mechanism allowing the rotation of said crank or knob 58 only if a predetermined number of suitable coins or tokens has been introduced through one or more inlet slots. The coin or token selector 6 and said delivery outlet 7, as well as an access opening 53 to a coin or token collection box 52, are arranged in a front panel 10 of the structure 1, and a door 15 (shown in FIG. 1 in a open position) is joined to the structure 1 by means of a hinge 16 and arranged to cover said front panel 10 in a closed position (shown in FIG. 13). The mentioned door 15, which is shown separately in FIG. 10, includes a first opening 56 allowing the access to the crank or knob 58 of the coin or token selector 6 and a second opening 24 allowing the access to said delivery outlet 7 when the door 15 is in the closed position, whereas the door 15 itself prevents the access to the mentioned coin or token collection box 52. A closure mechanism 55 which can be actuated by means of a key from the outside allows locking the door 15 in the closed position.

Figure 2:
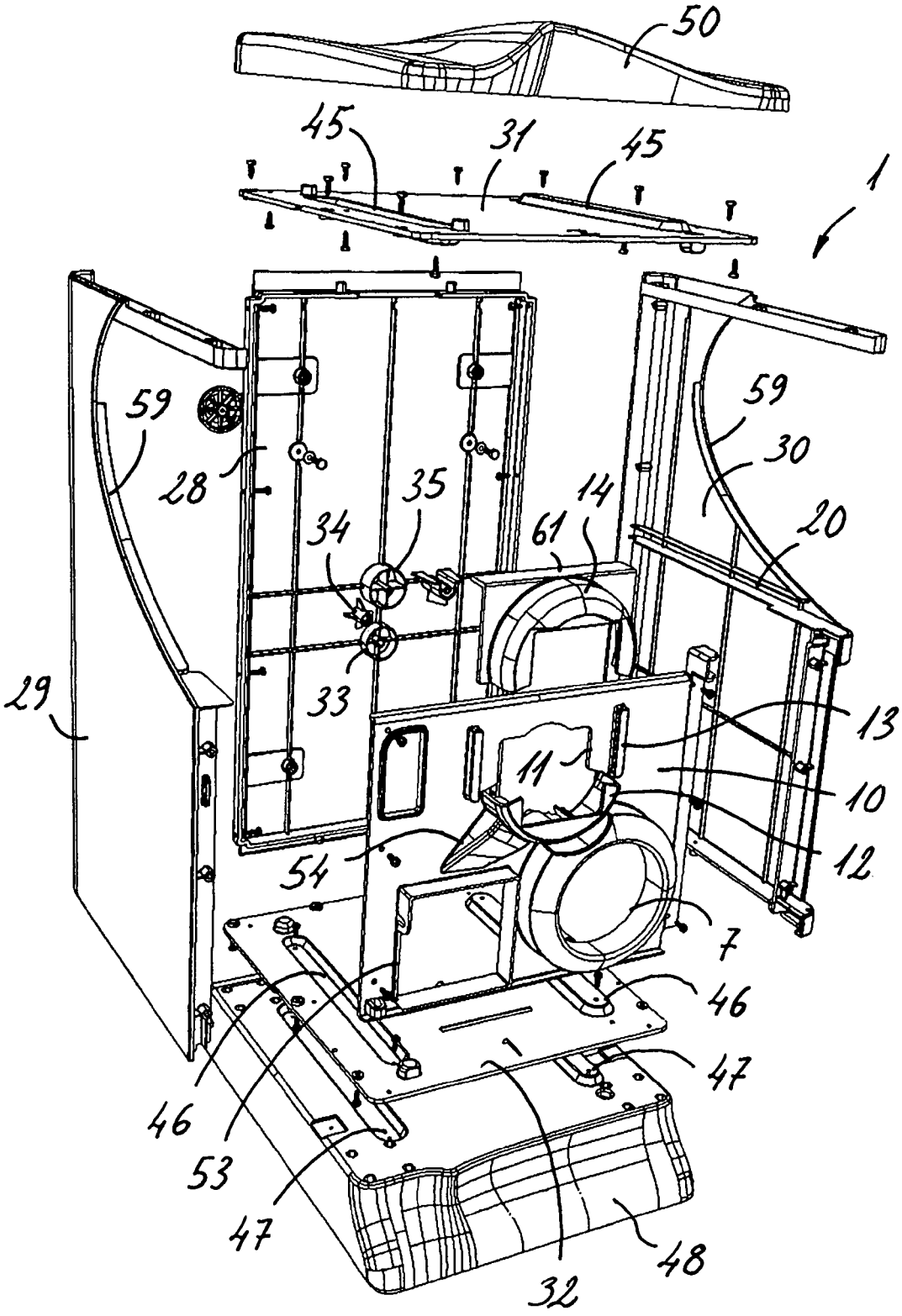
FIG. 2 shows a perspective exploded view of the structure of the machine of FIG. 1, including a pedestal and an upper finishing.

With reference now to FIG. 2, in addition to the mentioned front panel 10, the structure 1 comprises a rear panel 28, a pair of side panels 29, 30, an upper panel 31 and a lower panel 32, connected to one another forming a parallelepiped hollow body. The front panel 10 has a smaller height than said rear and side panels 28, 29, 30 to provide an opening between an upper edge of the front panel 10 and said upper panel 31 through which the container 2 is installed. In the embodiment shown, the side panels 29, 30 include trimmings 59 conjugated with transparent portions of the side walls of the container 2. Both the panels 10, 28, 29, 30, 31 32 forming the structure 1, and the parts 18, 19 forming the container 2, as well as a pedestal 48 and an upper finishing 50, which will be explained in more detail below, are obtained by the injection molding of a plastic material. Horizontal guides 20 are defined in the side panels 29, 30 of the structure 1, along which guides the base frame 18 of the container 2 is adapted to slide and on which the container 2 is supported.

The front panel 10 of the structure 1 comprises an opening 11 opposite to an end of the actuation shaft 4 and provided for connecting the mentioned actuation shaft 4 to the drive shaft 5 of the coin or token selector 6. Next to a lower part of said opening 11, the panel 10 defines a fixed mount 12 provided for receiving and fitting a part of the coin or token selector 6 (also see FIG. 4). The position of this fixed mount 12 is such that the drive shaft 5, once the coin or token selector 6 is in its operating position, is aligned with the actuation shaft 4. Next to the sides of the opening 11 there is a guide device 13 adapted for the sliding insertion of a moving mount 14 provided to be coupled by fitting in another part of the coin or token selector 6, contributing to immobilize the coin or token selector 6 in its operating position. The mentioned fixed and moving mounts 12, 14, as well as said guide device 13, are adapted and arranged to allow sliding movements of the coin or token selector 6 in a direction transverse to the actuation shaft 4 when such selector is installed and uninstalled. It is obviously necessary for the actuation shaft 4 to be uncoupled from the drive shaft 5 in order to carry out these movements of the coin or token selector 6.

To that end, the actuation shaft 4 has mounted next to its end a coupling 8 (FIGS. 3, 4, 5 and 8) which can slide in the longitudinal direction of the actuation shaft 4 between a coupled position (FIG. 4) and an uncoupled position (FIG. 5), but cannot rotate in relation thereto. A stop 60 is fixed in the actuation shaft 4, and elastic means 9 are arranged between said stop 60 and the coupling 8, for example in the form of a helical spring wound on the actuation shaft 4, to push the coupling 8 towards said coupled position. The coupling 8 has at one end a cavity (not shown) with a non-circular contour, a polygonal contour for example, adapted to receive an end of the drive shaft 5 having a conjugated non-circular cross-sectional profile.

Figure 4:
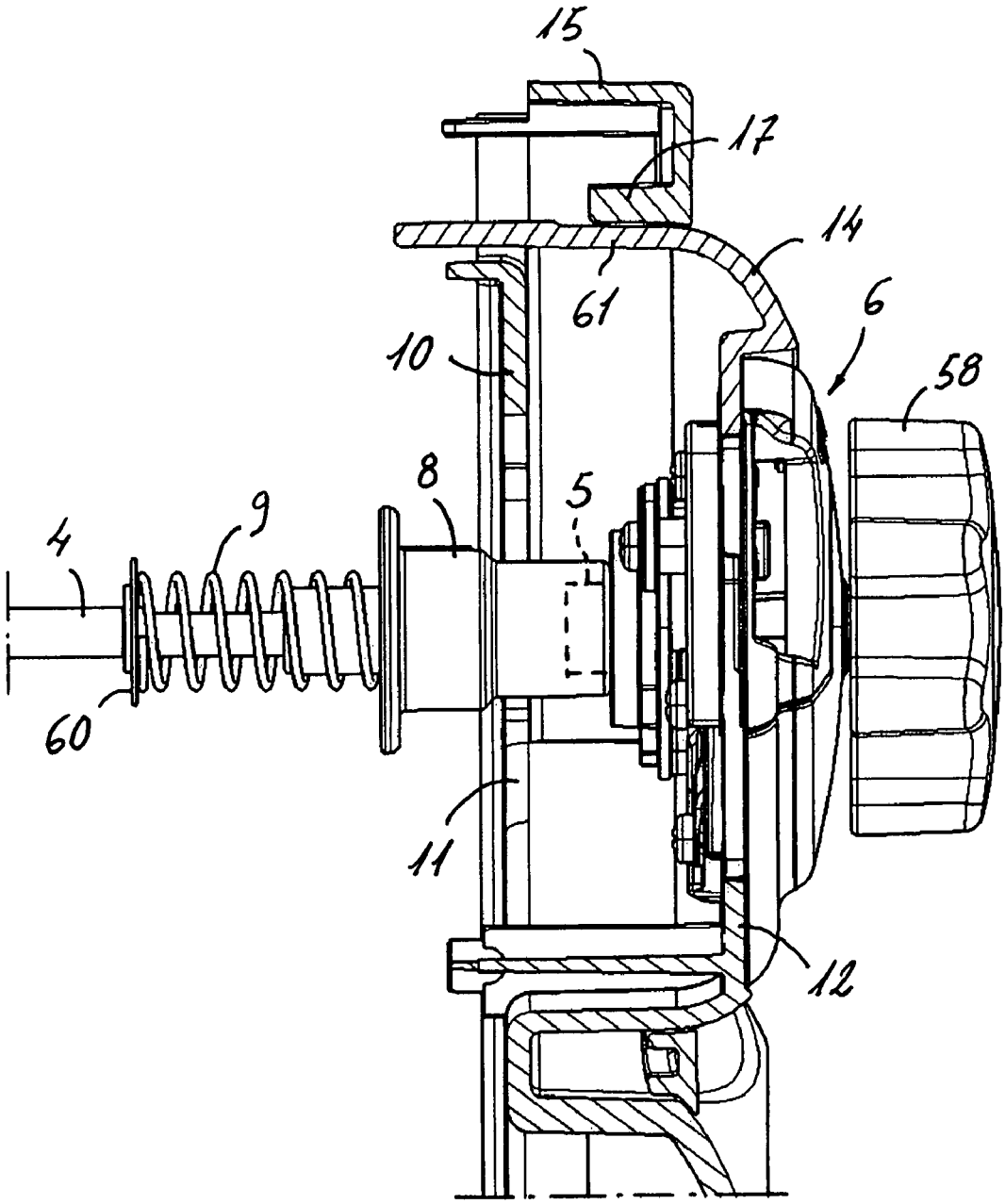
FIG. 4 shows a partial cross-sectional view showing the actuation shaft coupled to the drive shaft of the coin selector in an operating position.
Figure 5:
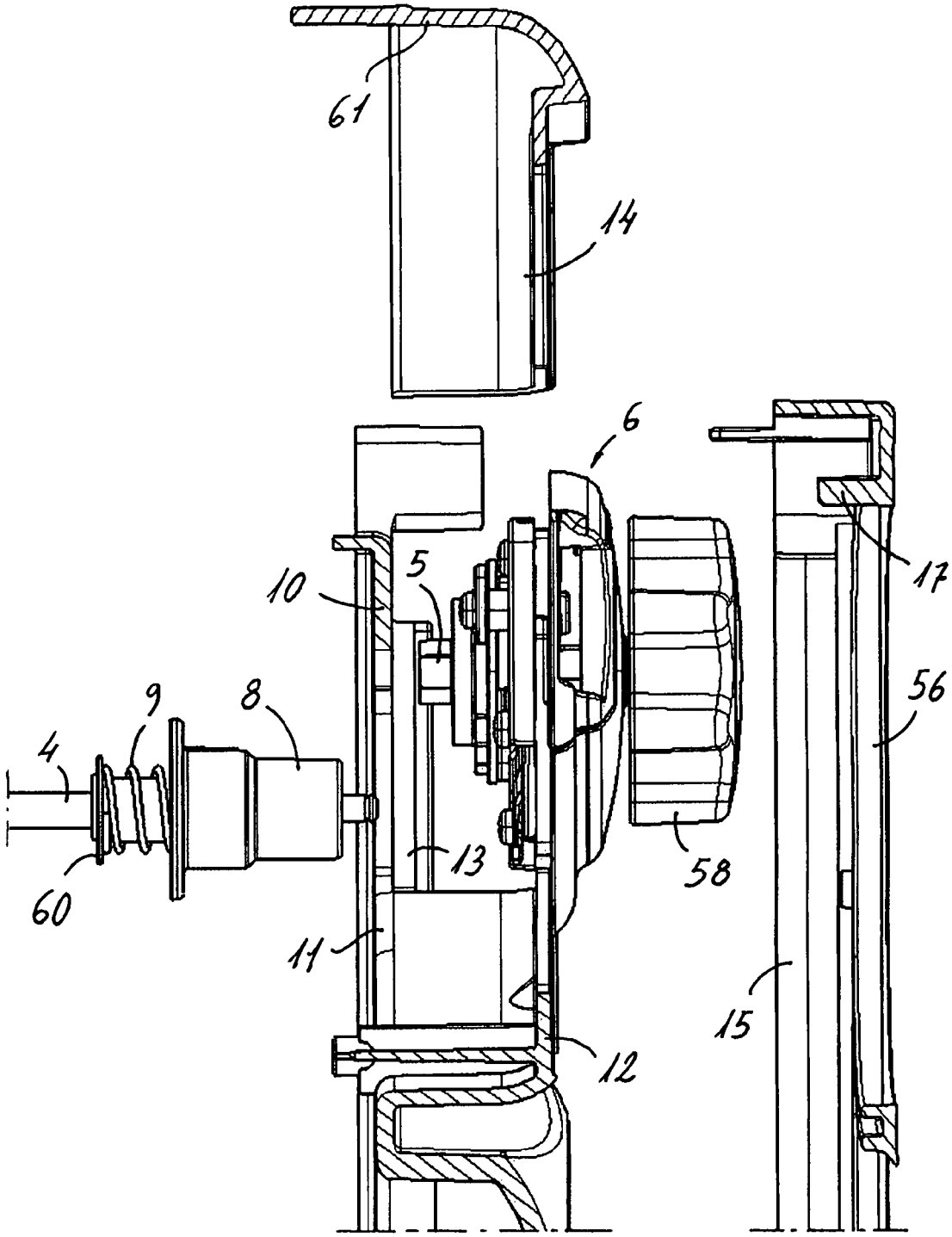
FIG. 5 shows a partial cross-sectional view similar to FIG. 4, in which the actuation shaft is uncoupled from the drive shaft of the coin selector, and the latter is being removed.

FIG. 4 shows the coin or token selector 6 housed in the lower mount 12 of the front panel 10, with the drive shaft 5 opposite to the opening 11. The upper mount 14 is installed in the guide device 13 to hold the upper part of the coin or token selector 6, and the coupling 8 is in its position coupled to the drive shaft 5. In this coupled position, the coupling 8 can transmit a turning torque from the drive shaft 5 to the actuation shaft 4. In FIG. 5, the coupling 8 is in its uncoupled position, in which it is completely removed from the drive shaft 5, therefore the drive shaft 5 is released to allow removing or placing the coin or token selector 6. Thus, in FIG. 5, for example, the upper mount 14 has been removed from the guide device 13 to release the upper part of the coin or token selector 6, and the latter has been transversely moved upwards so as to release it from the lower mount 12, for the purpose of completely removing it. In reverse operation for installing the coin or token selector 6, keeping the coupling 8 in its uncoupled position, the coin or token selector 6 would first be placed in the lower mount 12, with the drive shaft 5 aligned with the actuation shaft 4. The upper mount 14 would be then located in its place in the guide device 13, and the coupling 8 would be finally released to couple it to the drive shaft 5 by the force of the elastic means 9.

A flap 61 is formed next to an upper edge of the upper mount 14, which flap is superimposed to an upper edge of the of the front panel 10 when the upper mount is in its operating position. The door 15 includes in its upper inner part a locking configuration 17 adapted to be superimposed to said flap 61 of the moving mount 14 in an operating position when the door 15 is in the closed position. The mentioned locking configuration 17 of the door 15 thus immobilizes the moving mount 14, which in turn locks the coin or token selector 6 in its operating position, and the closure device 55 can be actuated by means of the corresponding key to lock the door 15 in the closed position.

Figure 10:
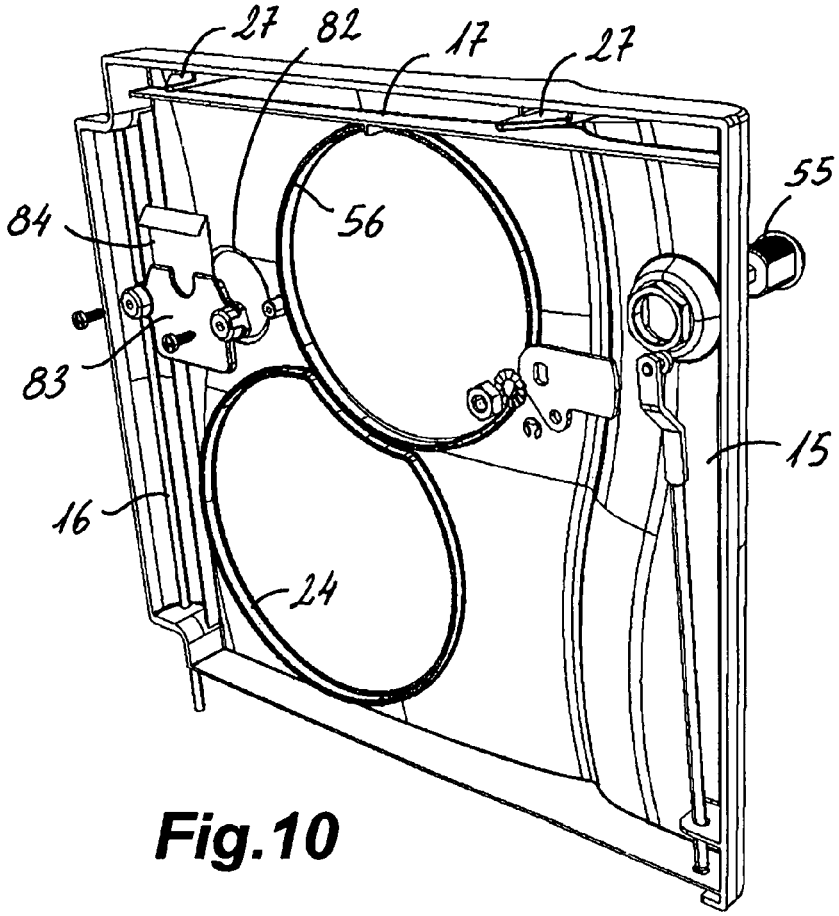
FIG. 10 shows a perspective exploded view of the door.

FIG. 10 separately shows the door 15 from its inner face. As described above, the door 15 incorporates a shaft for hinge 16, the first and second openings 56, 24, the locking configuration 17, the cam profiles 27 and the closure device 55. The door 15 further includes a window 82 opposite to a pocket defined by a part 83 fixed to the inner face of the door 15. The mentioned pocket is adapted to receive the insertion of a sheet 84 incorporating information relating to the number and type of coins or tokens which must be introduced in the coin or token selector 6 for example. This sheet 84 can be seen through the window 82 and can be replaced easily. In the event that the machine incorporates a coin or token selector 6 like the one described below with reference to FIGS. 11 and 12, the sheet 84 can have information printed on either side relating to either of the two possible forms of use, i.e. for one or two coins or tokens, and the sheet 84 can easily show the suitable face for the selected form of use.

Figure 11:
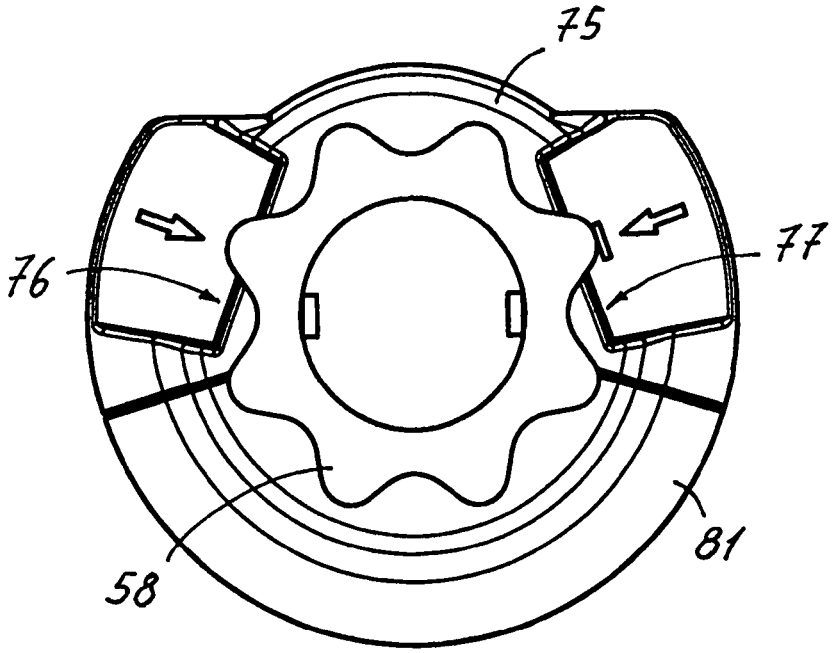
FIG. 11 shows a front elevational view of a coin selector used in the machine of FIG. 1 adapted to receive two coins in each operative cycle.
Figure 12:
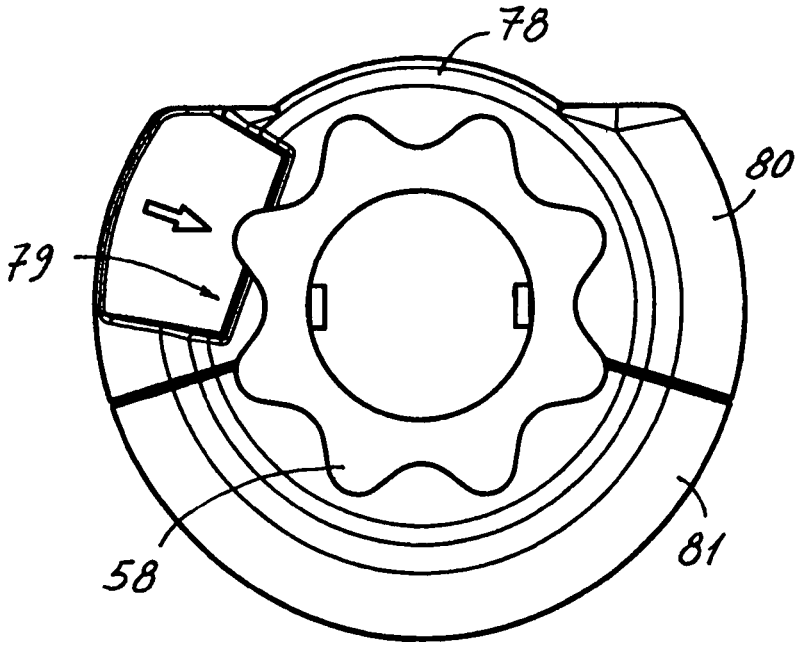
FIG. 12 shows a front elevational view of the coin selector of FIG. 11 adapted to receive a single coin in each operative cycle.

FIGS. 11 and 12 show a suitable coin or token selector 6 for the machine of the present invention, which is described in document ES-A-1058036, of this applicant. However, the invention is not limited to this coin or token selector, because the machine can incorporate any coin or token selector 6 having a suitable output drive shaft 5. The coin or token selector 6 shown in FIGS. 11 and 12 comprises a body 81 housing a mechanism adapted to select two coins or tokens introduced through two different inlets in each operative cycle. The mentioned mechanism includes the mentioned drive shaft 5, a knob 58 adapted to be actuated by a user is connected to an outer end of such shaft. In some embodiments, the knob 58 can be substituted with a winch or another crank. The mentioned body 81 has a recessed portion in which a first entrance part 75, shown in FIG. 11, or a second entrance part 78, shown in FIG. 12, can be indistinctly incorporated.

The mentioned first entrance part 75 shown in FIG. 11 defines two slots 76, 77 respectively opposite to said two inlets of the mechanism, to allow introducing two coins or tokens. Alternatively, the second entrance part 78 shown in FIG. 12 defines a single slot 79 opposite to one of the two inlets to allow introducing a single coin or token. The second entrance part 78 includes a blocking portion 80 preventing the access to the other of the two inlets, and an inner configuration (not shown) adapted to cancel the action of at least one element of said mechanism in correspondence with the blocked inlet.

Figure 6:
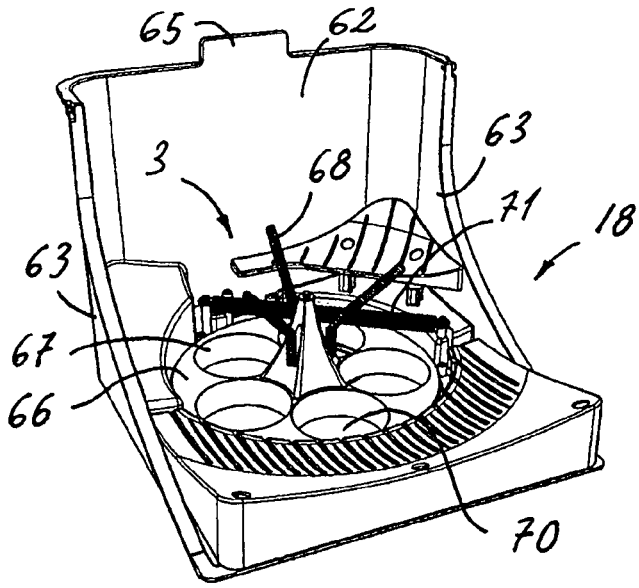
FIG. 6 shows a perspective view showing the removal mechanism installed in a base frame of the container.

FIG. 6 shows the base frame 18 mentioned above, which forms part of the container 2. In the embodiment shown, the base frame 18 integrates in a single part a rear wall 62 of the container 2 and a part 63 of several side walls, whereas a transparent part 19 and the rest 64 of the side walls are integrated in another part made of transparent material (shown in FIG. 7) adapted to be coupled and fixed to the base frame 18 to complete the container 2. A flap 65 projecting from rear wall 62 is used to limit the outward movement of the container in the filling position (FIG. 1). However, the container 2 can be completely removed from the filling position by pulling outwards the lower part of such container.

Figure 7:
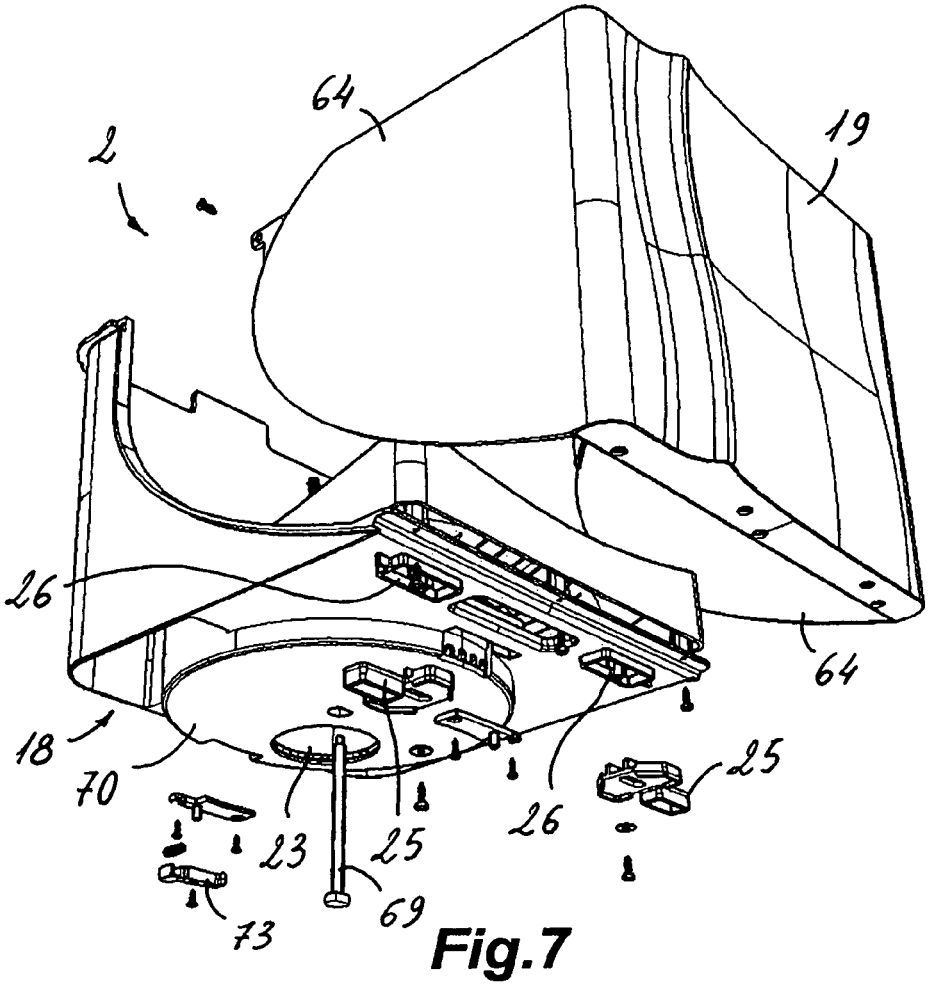
FIG. 7 shows a perspective exploded view of the container showing its lower part.

In the base frame 18 there is arranged the removal mechanism 3, which is of a known type and comprises a rotor 66 in which there are formed a number of cavities 67 with no bottom, each cavity being provided to partially house an article and several stirring elements. The rotor is mounted to rotate with respect to a shaft 69 above a support plane 70 of the base frame 18, in which an exit 23 is formed (FIG. 7). Above the rotor 66, and in the position of said exit 23, there is arranged a retaining element 71 preventing the article from being housed in the cavity 67 which is located in this position. When the rotor 66 rotates, one of the cavities 67 reaches the position of the exit 23 and the article which is located in said cavity 67 falls by gravity through the exit 23.

As can best be seen in FIG. 7, a pair of bolts 25 are arranged in a lower front part of the base frame 18 (although there could be only one or more than two bolts with an equivalent result). Each of these bolts 25 is mounted in a guided manner in a corresponding configuration 26 of the base frame 18 such that they can be moved between a fastened position, in which the bolt 25 is fastened in a corresponding configuration of the structure 1, thus maintaining the container 2 in its working position, and a released position, in which the bolt 25 does not interfere with said configuration of the structure 1, allowing the movement of the container 2. The door 15 includes, for each bolt 25, a cam profile 27 (FIGS. 1 and 10) arranged to push the bolt 25 towards its fastened position when the door 15 is in the closed position. When the door 15 is in the closed position shown in FIG. 13, and immobilized by the closure device 55, the container is thus blocked in its working position by the bolts 25. In order to refill the container for example, it is enough to open the door 15, manually move the bolts 25 to their released position, and pull the container outwards until its filling position shown in FIG. 1.

Figure 3:
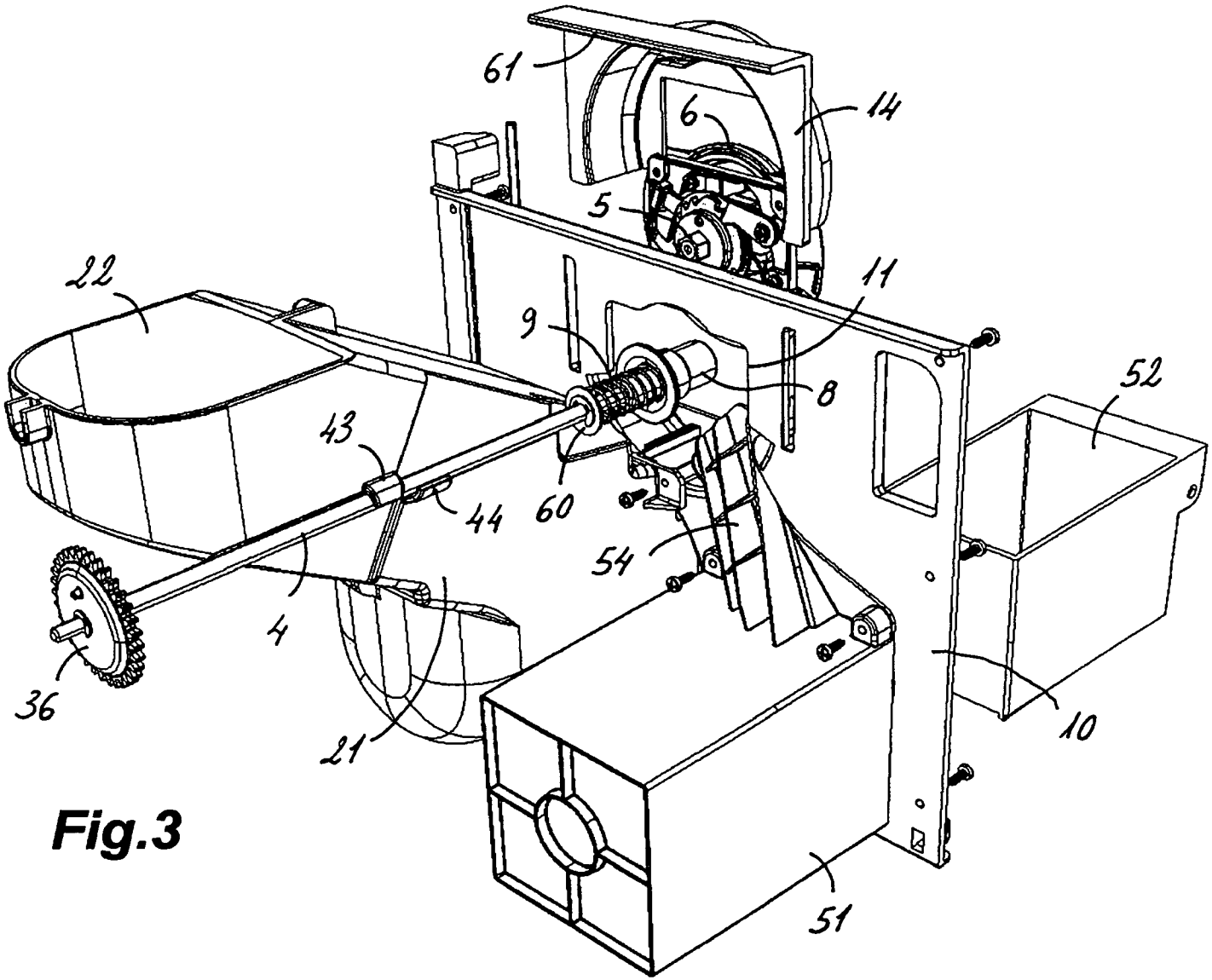
FIG. 3 shows a perspective exploded view showing different mechanisms associated to the structure in relation to a front panel thereof.
Figure 8:
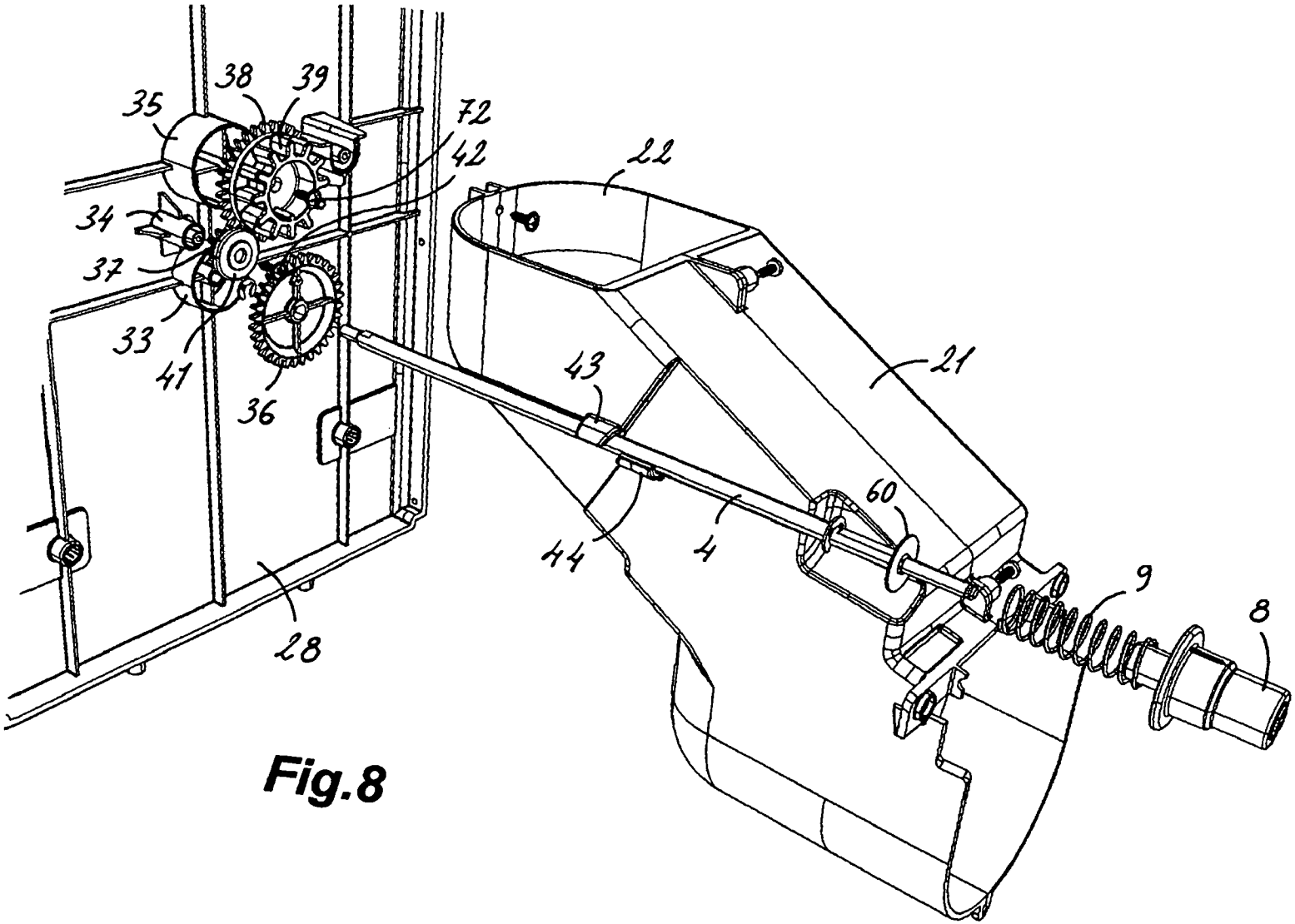
FIG. 8 shows a perspective exploded view showing different mechanisms associated to the structure in relation to a rear panel thereof.
Figure 9:
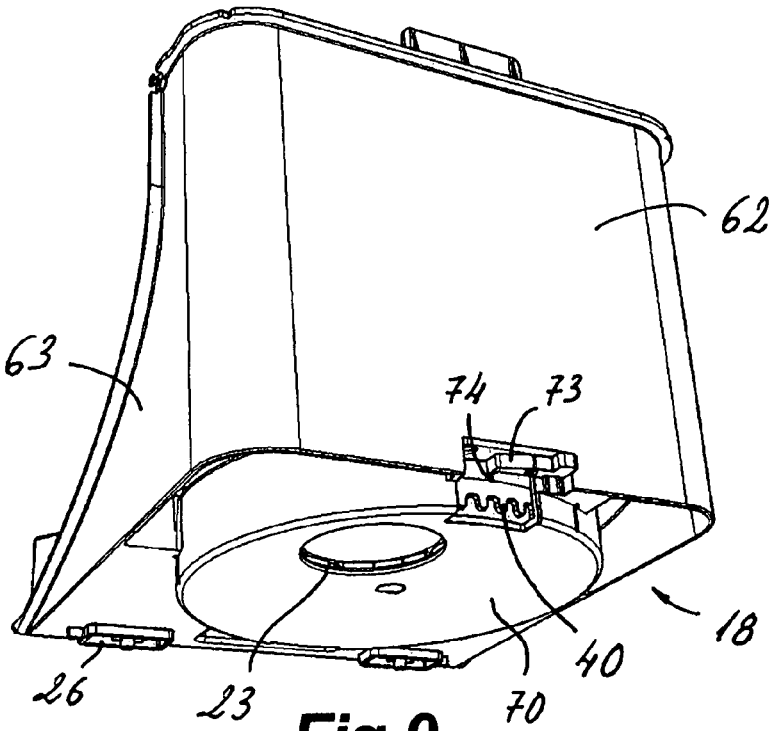
FIG. 9 shows a perspective view showing an access to a gear ring of the removal mechanism from a rear part of the base frame of the container.

Given that the removal mechanism 3 moves together with the container, the machine comprises a delivery duct 21 fixed to the structure 1, as shown in FIGS. 3 and 8. The mentioned delivery duct 21 has an inlet 22 located in a position which is under the exit 23 of the dispensing mechanism 3 when the container 2 is in its working position. The delivery duct 21 ends in an opening formed in the front panel 10 defining said delivery outlet 7 which, as usual, will include any type of gate. A housing 51 for said collection box 52 is fixed in the lower part of the front panel 10 (FIG. 3), which housing can be accessed through the opening 53 of the front panel 10 when the door 15 is in the open position. A collection duct 54 is arranged to lead the coins or tokens from an exit of the coin or token selector 6 to an inlet of said housing 51.

The actuation shaft 4 is horizontally installed with the end having the coupling 8 opposite to the opening 11 of the front panel 19 and with the opposite end mounted in the rear panel 28. In order to guide and support an intermediate portion of the actuation shaft 4, the machine includes a guiding configuration formed in a side panel of said delivery duct 21. This guiding configuration comprises an upper half bearing 43, configured to clasp and guide an upper half of the actuation shaft 4, and a lower half bearing 44, configured to clasp and guide a lower half of the actuation shaft 4. Both upper and lower half bearings 43, 44 are mutually aligned and axially moved and separated by a distance that is enough to allow the passage of said intermediate portion of the actuation shaft 4 in a radial direction when the longitudinal shaft thereof is in an inclined position different from its horizontal working position. The actuation shaft 4 can thus be removed without the use of tools by uncoupling the coupling 8 and releasing the rear end of the actuation shaft 4 in the manner which will be described below.

With reference now to FIG. 8, assembly configurations 33, 34, 35 are incorporated in an inner face of the rear panel 28 for the installation of a train of gear wheels comprising an input gear wheel 36, which is integrally connected to the rear end of the actuation shaft 4. This rear end of the actuation shaft 4 projects beyond said input gear wheel 36 and is simply inserted and guided in its corresponding assembly configuration 33, but it is not retained therein. The train of gear wheels comprises an output gear wheel 38, which is coaxially joined to a driving pinion 39, and the assembly of both wheels is mounted such that it can rotate retained in its corresponding assembly configuration 35, for example, by means of an axial screw 72. The train of gear wheels is completed with an intermediate gear wheel 37, which is simultaneously engaged with said input and output gear wheels 36, 38.

This intermediate gear wheel 37 is axially fixed in its corresponding assembly configuration 34 by means of a screw 42, and comprises, in its side furthest from the rear panel 28, a ring-shaped flange 41 extending at one side of its teeth for the purpose of preventing a movement in the axial direction of the teeth of the input and output gear wheels 36, 38. Therefore, when the intermediate gear wheel 37 is fixed in an assembly configuration 34, its ring-shaped flange 41 retains the actuation shaft 4 in position. In order to release the rear end of the actuation shaft 4, it is enough to loosen the screw 42, with a screwdriver for example, and remove the intermediate gear wheel 37.

The mentioned driving pinion 39, which is coaxially integral with the output gear wheel 38, is configured and arranged to engage with a gear ring 40 formed in the periphery of the rotor 66 of the dispensing mechanism 3 through an opening 57 of the base frame 18 of the container 2 when the container 2 is in its working position. The driving pinion 39 and said gear ring 40 are automatically engaged when the container 2 is moved to its working position, and are automatically disengaged when the container 2 starts moving to its filling position. To ensure that the rotor 66 remains in a suitable angular position so that one of its cavities 67 coincides with the exit 23 when the gear ring 40 is disengaged from the driving pinion 39, a retaining finger 73 is mounted in the base frame 18, which finger is elastically pushed against the periphery of the rotor 66 through said opening 57 so as to interlock in slots 74 existing in the periphery of the rotor 66 in the suitable angular positions.

When all the elements of the machine are in their working or operating positions (FIG. 13), a manual rotation of the crank or knob 58 of the coin or token selector 6, after introducing the required coin or token, translates into a rotation of the drive shaft 5 which is transmitted to the actuation shaft 4 through the coupling 8. The rotation of the actuation shaft 4 is transmitted to the driving pinion 39 through the train of gear wheels 36, 37, 38, and the engagement of the driving pinion with the gear ring 40 makes the rotor 66 of the dispensing mechanism 3 rotate an angle that is equivalent to the angle between two cavities 67 to exchange the empty cavity 67 which is located on the exit 23 for another full cavity.

Returning to FIG. 2, the upper panel 31 and the lower panel 32 of the structure 1 comprise respective positioning configurations 45, 46 in the form of mutually conjugated embossments and depressions. The aforementioned pedestal 48 has an upper portion provided with positioning configurations 47 in the form of embossments and depressions adapted to fit in the positioning configurations 46 of the lower panel 32. In a similar panel, the mentioned upper finishing 50 is adapted to be mounted on the upper panel 31. The pedestal 48 optionally comprises wheels 49 (FIG. 1) fixed to its lower part.

Figure 13:
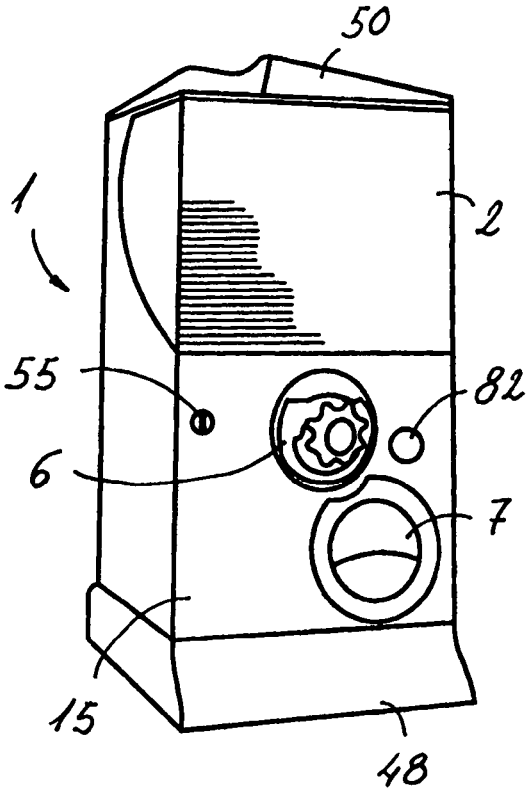
FIG. 13 shows a perspective view of the machine of the present invention according to a simple configuration including a single structure like that of FIG. 2.
Figure 14:
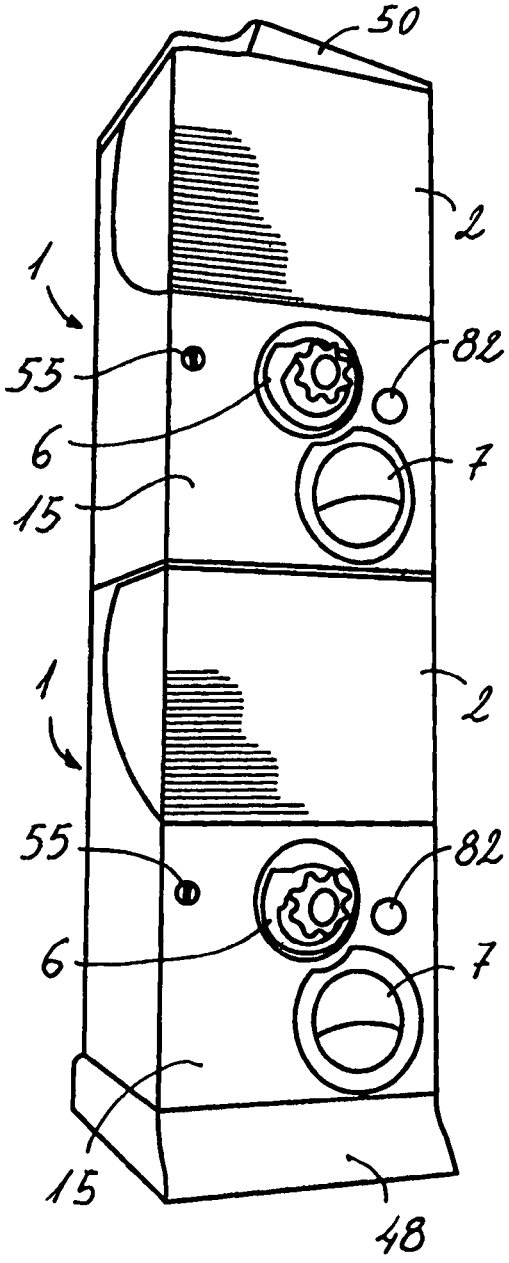
FIG. 14 shows a perspective view of the machine of the present invention according to a multiple configuration including two structures like those of FIG. 2.

As shown in FIGS. 13 and 14, the machine can be mounted according to different configurations with these elements. FIG. 13 shows a machine according to the present invention according to a simple configuration, comprising a single structure 1 with a pedestal 48 and an upper finishing 50. FIG. 14 shows a machine according to the present invention according to a multiple configuration, in which two structures 1 are superimposed and fixed to one another with the mentioned positioning configurations 45 of the upper panel 31 of the lower structure fitted in the positioning configurations 46 of the lower panel 32 of the other superimposed similar structure 1. In this case the pedestal is joined to the lower panel of the lower structure 1 and the upper finishing superior is mounted on the upper panel of the upper structure 1. Although it is considered that a column configuration of two superimposed structures 1 is sufficient, there is no technical limitation for forming columns of three or more structures 1, provided that its stability is ensured, The structures 1 can also be laterally attached to form multiple configurations (not shown) formed by rows of two or more simple structures 1, or rows of two or more columns of two or more structures 1 each. In all cases, a pedestal 48 will be mounted under each lower structure 1 and a finishing 50 will be arranged on each upper structure 1.

A person skilled in the art will be able to introduce variations and modifications in the embodiments shown and described without departing from the scope of the present invention as it is defined in the attached claims.

The invention claimed is:

1. An article-dispensing machine comprising a structure supporting a container for articles to be dispensed, a dispensing mechanism arranged in the base of said container, said dispensing mechanism being actuated by an actuation shaft to perform actuation cycles, a coin or token selector having a drive shaft coupled to said actuation shaft by means of a coupling to make the actuation shaft rotate together with said drive shaft, the drive shaft being enabled to rotate by the introduction of one or more coins or tokens in said coin or token selector to dispense a predetermined number of said articles from the container through a delivery outlet in each actuation cycle of the dispensing mechanism, characterized in that said coupling is mounted on said actuation shaft such that said mounting can slide along but cannot rotate about the actuation shaft, said coupling being axially movable on the actuation shaft between a coupled position, in which said coupling is coupled to the drive shaft to transmit a turning torque from the drive shaft to the actuation shaft, and an uncoupled position, in which the coupling is completely removed from the drive shaft to enable the coin or token selector to be withdrawn or installed, elastic means being arranged on the actuation shaft to push the coupling towards said coupled position.

2. A machine according to claim 1, characterized in that a front panel of said structure comprises an opening opposite to an end of the actuation shaft, a fixed mount arranged next to said opening, said fixed mount being provided to receive by fitting a part of the coin or token selector in an operating position in which the drive shaft is aligned with the actuation shaft, and a guide device for the sliding insertion of a moving mount, said moving mount being provided to fit into another part of the coin or token selector, contributing to immobilize the coin or token selector in said operating position.

3. A machine according to claim 2, characterized in that said fixed and moving mounts and said guide device are adapted to allow sliding movements of the coin or token selector in a direction transverse to the actuation shaft to install and uninstall the coin or token selector when the coupling is in said uncoupled position.

4. A machine according to claim 3, characterized in that it comprises a door joined to the structure by means of a hinge and arranged to cover said front panel in a closed position, said door including a first opening allowing the access to the coin or token selector and a locking configuration adapted to immobilize the moving mount in an operating position when the door is in said closed position.

5. A machine according to claim 4, characterized in that the container comprises a base frame, in which the dispensing mechanism is mounted, and side walls, at least one of which is a transparent wall, said base frame of the container being adapted to move horizontally in a sliding manner in guides of the structure between a filling position, in which a portion of the container projects from the structure providing an upper filling opening, and a working position, in which the container is integrated in the structure and the dispensing mechanism is operatively connected to the actuation shaft.

6. A machine according to claim 5, characterized in that it comprises a delivery duct fixed to the structure, which duct has an inlet located under an exit of the dispensing mechanism when the container is in its working position, and ends in an opening formed in the front panel defining said delivery outlet, a second opening being formed in the door, which opening allows accessing to said delivery outlet when the door is in the closed position.

7. A machine according to claim 6, characterized in that it comprises at least one bolt mounted in a guided manner in the base frame of the container to be moved between a fastened position, in which said bolt is fastened in a configuration of the structure keeping the container in its working position, and a released position, in which the bolt does not interfere with said configuration of the structure, allowing the movement of the container, the door including a cam profile arranged to push the bolt towards its fastened position when the door is in the closed position.

8. A machine according to claim 6, characterized in that the door is equipped with a closure mechanism adapted to be actuated from the outside by means of a key for the purpose of locking the door in the closed position.

9. A machine according to claim 4, characterized in that it comprises a housing for a collection box which can be accessed through an opening of the front panel when the door is in the open position, and a collection duct arranged to lead coins or tokens from an exit of the coin or token selector to an inlet of said housing.

10. A machine according to claim 6, characterized in that the structure comprises, in addition to the mentioned front panel, a rear panel, a pair of side panels, an upper panel and a lower panel, in which the front panel has a smaller height than said rear and side panels to provide an opening between an upper edge of the front panel and said upper panel.

11. A machine according to claim 4, characterized in that assembly configurations are incorporated in an inner face of the rear panel for the installation of a train of gear wheels comprising an input gear wheel connected to the end of the actuation shaft and an output gear wheel coaxially joined to a driving pinion configured and arranged to engage with a gear ring of the dispensing mechanism through an opening of the base frame of the container when the container is in its working position.

12. A machine according to claim 11, characterized in that said train of gear wheels comprises an intermediate gear wheel simultaneously engaged with said input and output gear wheels, said intermediate gear wheel having in its side furthest from the rear panel a ring-shaped flange extending to the side of the teeth for the purpose of axially retaining the input and output gear wheels when the intermediate gear wheel is axially fixed in its corresponding assembly configuration by means of a screw.

13. A machine according to claim 12, characterized in that a guiding configuration is arranged in a side wall of said delivery duct to guide and support an intermediate portion of the actuation shaft, said guiding configuration comprising an upper half bearing and a lower half bearing that are axially moved and separated sufficiently to allow the passage of said intermediate portion of the actuation shaft in a radial direction when the longitudinal shaft thereof is in a position different from its working position.

14. A machine according to claim 10, characterized in that the upper panel and said lower panel comprise respective conjugated positioning members, said positioning members of the upper panel of a structure being adapted to fit in said positioning members of the lower panel of another superimposed similar structure.

15. A machine according to claim 14, characterized in that it comprises a pedestal with an upper portion provided with positioning members adapted to fit in the positioning members of the lower panel.

16. A machine according to claim 15, characterized in that said pedestal comprises wheels.

17. A machine according to claim 14, characterized in that it comprises an upper trimming adapted to be mounted on the upper panel.

18. A machine according to claim 1, characterized in that the coin or token selector comprises a mechanism adapted to select two coins or tokens introduced through two different inlets in each operative cycle, and is adapted to indistinctly incorporate a first entrance part defining two slots respectively opposite to said two inlets to allow introducing two coins or tokens or a second entrance part defining a single slot opposite to one of the two inlets to allow introducing a single coin or token, said second entrance part including a blocking portion preventing the access to the other of the two inlets, and means for cancelling the action of at least one element of said mechanism in correspondence with the blocked inlet.

19. An article-dispensing machine, of the type comprising a structure supporting a container for articles to be dispensed, a dispensing mechanism arranged in the base of said container and actuated by an actuation shaft coupled to a drive shaft of a coin or token selector to dispense a predetermined number of said articles from the container through a delivery outlet in each actuation cycle of said dispensing mechanism controlled by the introduction of one or more coins or tokens in said coin or token selector, characterized in that: said actuation shaft is coupled to said drive shaft of the coin or token selector by means of a coupling adapted to be easily and quickly released by moving it on the actuation shaft against the force of elastic means; the coin or token selector is installed in a sliding manner in a fixed mount of a front panel of said structure, and retained in position with the cooperation of a moving mount; the container is adapted to be horizontally installed in a sliding manner in guides of the structure, and has incorporated at least one bolt adapted to be moved to a fastened position with respect to a configuration of the structure when the container is in a working position; and in that it comprises a door joined in a hinged manner to the structure and arranged to cover said front panel when it is in a closed position, said door including a first opening which allows accessing the coin or token selector, a locking configuration adapted to immobilize said moving mount, and thus lock the coin or token selector in an operating position, and a cam profile arranged to push the bolt towards its fastened position, all this when the door is in said closed position.

20. A machine according to claim 2, characterized in that the coin or token selector comprises a mechanism adapted to select two coins or tokens introduced through two different inlets in each operative cycle, and is adapted to indistinctly incorporate a first entrance part defining two slots respectively opposite to said two inlets to allow introducing two coins or tokens or a second entrance part defining a single slot opposite to one of the two inlets to allow introducing a single coin or token, said second entrance part including a blocking portion preventing the access to the other of the two inlets, and means for cancelling the action of at least one element of said mechanism in correspondence with the blocked inlet.

21. A machine according to claim 3, characterized in that the coin or token selector comprises a mechanism adapted to select two coins or tokens introduced through two different inlets in each operative cycle, and is adapted to indistinctly incorporate a first entrance part defining two slots respectively opposite to said two inlets to allow introducing two coins or tokens or a second entrance part defining a single slot opposite to one of the two inlets to allow introducing a single coin or token, said second entrance part including a blocking portion preventing the access to the other of the two inlets, and means for cancelling the action of at least one element of said mechanism in correspondence with the blocked inlet.

22. A machine according to claim 7 characterized in that the door is equipped with a closure mechanism adapted to be actuated from the outside by means of a key for the purpose of locking the door in the closed position.

* * * * *